US011021973B2

(12) United States Patent
De Gaillard et al.

(10) Patent No.: US 11,021,973 B2
(45) Date of Patent: Jun. 1, 2021

(54) BLADE PLATFORM AND A FAN DISK FOR AN AVIATION TURBINE ENGINE

(71) Applicant: SAFRAN AIRCRAFT ENGINES, Paris (FR)

(72) Inventors: Thomas Alain De Gaillard, Moissy-Cramayel (FR); Alexandre Bernard Marie Boisson, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 109 days.

(21) Appl. No.: 16/086,492

(22) PCT Filed: Mar. 20, 2017

(86) PCT No.: PCT/FR2017/050649
§ 371 (c)(1),
(2) Date: Sep. 19, 2018

(87) PCT Pub. No.: WO2017/162975
PCT Pub. Date: Sep. 28, 2017

(65) Prior Publication Data

US 2019/0055847 A1 Feb. 21, 2019

(30) Foreign Application Priority Data

Mar. 21, 2016 (FR) ..... 1652401

(51) Int. Cl.
*F01D 5/30* (2006.01)
*F01D 11/00* (2006.01)

(52) U.S. Cl.
CPC ..... *F01D 5/3015* (2013.01); *F01D 11/008* (2013.01); *F05D 2220/323* (2013.01);
(Continued)

(58) Field of Classification Search
CPC .... F01D 5/3007; F01D 5/3015; F01D 11/008; F05D 2240/80
See application file for complete search history.

(56) References Cited

U.S. PATENT DOCUMENTS 5,281,096 A * 1/1994 Harris ..... F01D 11/008 416/193 A
6,634,863 B1 * 10/2003 Forrester ..... F01D 5/06 416/193 A
(Continued)

FOREIGN PATENT DOCUMENTS

CN 102105655 A 6/2011
CN 102472108 A 5/2012
(Continued)

OTHER PUBLICATIONS

English translation of Russian Federation Office Action dated Jun. 3, 2020 in Patent Application No. 2018136891/12(061110), 4 pages.
(Continued)

*Primary Examiner* — Richard A Edgar
*Assistant Examiner* — Jackson N Gillenwaters
(74) *Attorney, Agent, or Firm* — Oblon, McClelland, Maier & Neustadt, L.L.P.

(57) ABSTRACT

A platform suitable for being interposed between two adjacent blades of a fan, and including a passage wall, a bottom wall, and axial and radial retention surfaces. The passage wall defines a fan air flow passage, the bottom wall presents a main surface for bearing against a fan disk, and the axial and radial retention surfaces are arranged at the two axial ends of the platform. The radial retention surface arranged at the upstream axial end of the platform is radially offset from the main surface of the bottom wall in the direction in which the bottom wall bears against the disk.

13 Claims, 3 Drawing Sheets

(52) U.S. Cl.
CPC ..... *F05D 2220/36* (2013.01); *F05D 2230/60* (2013.01); *F05D 2240/80* (2013.01)

(56) References Cited

U.S. PATENT DOCUMENTS

| | | | | |
|---|---|---|---|---|
| 8,246,310 | B2 * | 8/2012 | Pierrot | F04D 29/321 416/220 R |
| 9,752,449 | B2 * | 9/2017 | Bottome | F01D 11/008 |
| 10,018,048 | B2 * | 7/2018 | Alarcon | F01D 5/025 |
| 10,024,234 | B2 * | 7/2018 | Duo | F02K 3/06 |
| 10,578,120 | B2 * | 3/2020 | Duelm | F01D 11/008 |
| 10,605,117 | B2 * | 3/2020 | Wang | F01D 25/005 |
| 2007/0217915 | A1 | 9/2007 | Fujimura et al. | |
| 2008/0226458 | A1 | 9/2008 | Pierrot et al. | |
| 2009/0269202 | A1 | 10/2009 | Borzakian et al. | |
| 2012/0244003 | A1 | 9/2012 | Mason | |
| 2016/0069355 | A1 | 3/2016 | Duo et al. | |
| 2019/0390559 | A1 * | 12/2019 | Guivarc'H | F01D 5/282 |

FOREIGN PATENT DOCUMENTS

| | | | |
|---|---|---|---|
| CN | 104884743 | A | 9/2015 |
| EP | 2 503 102 | A2 | 9/2012 |
| EP | 2 993 305 | A1 | 3/2016 |
| FR | 2 814 495 | | 3/2002 |
| GB | 2484988 | A | 5/2012 |
| JP | 2002-195102 | | 7/2002 |
| RU | 2 539 924 | C2 | 1/2015 |
| RU | 2 617 635 | C2 | 4/2017 |
| WO | WO 2009/144401 | A1 | 12/2009 |
| WO | WO 2014/143268 | A1 | 9/2014 |

OTHER PUBLICATIONS

International Search Report dated Sep. 5, 2017, in PCT/FR2017/050649 filed Mar. 20, 2017.

Combined Chinese Office Action and Search Report dated Sep. 16, 2020 in Patent Application No. 201780019114.2 (with English language translation), 15 pages.

Notice of Reasons for Rejection issued in Japanese Application No. 2018-549497 dated Jan. 19, 2021, with English translation, (13 pages).

* cited by examiner

BLADE PLATFORM AND A FAN DISK FOR AN AVIATION TURBINE ENGINE

FIELD OF THE INVENTION

The present invention relates to the general field of aviation turbine engines, and more precisely to the field of blade platforms and of a fan disk for an aviation turbine engine, to an assembly comprising the platforms and the disk, and to a fan including the assembly.

STATE OF THE PRIOR ART

In a turbine engine, the blade platforms of the fan need to perform several functions. From an aerodynamic point of view, the main function of the platforms is to define the air flow passage. They also need to be capable of withstanding large forces while deforming as little as possible and while remaining secured to the disk carrying them.

In order to satisfy these various requirements, certain configurations have been proposed in which platforms possess a first portion serving to define the air flow passage and to retain the platform while the engine is rotating, and a second portion serving to limit any deformation of the first portion under the effects of centrifugal forces and to hold the platform in position when the engine is stopped.

In existing solutions, the platform may be in the form of a box with a two-dimensional passage wall that is held downstream by a drum and upstream by a shroud, with upstream retention by the shroud taking place over the tooth of the fan disk (a flange of the shroud serving to block the upstream end of the platform both axially and radially).

Such upstream retention performed over the tooth of the disk by using a shroud presents the drawback of imposing a large hub ratio, where the hub ratio is the and the point of the leading edge of the blade that is flush with the surface of the platform divided by the radius measured between the axis of rotation and the outermost point of the leading edge. Furthermore, this upstream retention can give rise to excessive stresses on the tooth and in the recess of the disk where the connection is made between the shroud and the disk.

In order to optimize the performance of the fan, and more generally of the turbine engine, it is desirable to have an assembly comprising a platform fitted to the fan blade on a fan disk that presents a hub ratio that is as small as possible, while limiting stresses on the tooth and the recess of the disk.

SUMMARY OF THE INVENTION

An embodiment provides a platform suitable for being interposed between two adjacent blades of a fan, and comprising:

- a passage wall for defining a fan air flow passage;
- a bottom wall having a main surface for bearing against a fan disk; and
- the platform having axial and radial retention surfaces arranged at the two axial ends of the platform, characterized in that the radial retention surface arranged at the upstream axial end of the platform is radially offset from a main surface of the bottom wall in the direction in which the bottom wall bears against the disk.

The term "axial" is used to designate the longest direction of the platform, and the term "radial" is used to mean the direction perpendicular to the axial direction and to the main surface of a bottom wall.

The term "upstream" is used to mean upstream relative to the air flow direction when the platform is bearing against a fan disk.

The platform may be in the form of a box formed by assembling together the passage wall and the bottom wall. The passage wall serves to define the flow passage for air entering into the fan. The bottom wall serves to hold the passage wall in position and also to limit any deformation thereof under the effect of centrifugal forces. The bottom wall also has a main surface that can bear against a fan disk.

The axial and radial retention surfaces arranged at the two axial ends of the platform serve to retain the platform and hold it in position relative to the disk on which it bears while the disk is moving.

The radial retention surface arranged at the upstream axial end of the platform is radially offset relative to a main surface of the bottom wall. The term "radially offset" is used to mean offset in the direction in which the bottom wall bears against the disk. The radial retention surface and the main surface of the bottom wall may be substantially parallel to each other. This offset of the radial retention surface serves to modify the shape of the upstream axial end of the passage wall, and thus of the platform, compared with known platforms. For example, the platform may be in the form of a sloping box, i.e. a box having its upstream end radially offset relative to the main surface of the bottom wall. This modification to the shape of the platform thus serves to modify the air flow passage when the platform is arranged in a fan, and thus to reduce the hub ratio so as to increase the performance of the fan, and thus of the turbine engine in which the fan is mounted.

In certain embodiments, the bottom wall has an inclined surface inclined relative to the main surface of the bottom wall and connecting the main surface of the bottom wall in continuous manner with the radial retention surface arranged at the upstream axial end of the platform.

Since the radial retention surface arranged at the upstream axial end of the platform is radially offset relative to the main surface of the bottom wall, the inclined surface corresponds to the zone of the bottom wall that serves to compensate for the offset between the radial retention surface and the main surface of the bottom wall. Consequently, it can be understood that the inclined surface bears against the disk. The radial retention surface arranged at the upstream axial end of the platform, the inclined surface, and the main surface of the bottom wall may be integral and constitute the bottom wall.

The presence of this inclined surface enables the shape of the platform to be modified and optimized so as to decrease the hub ratio, thereby improving the performance of the fan and of the turbine engine.

In certain embodiments, the inclined surface is a rectilinear wall portion.

Consequently, the rectilinear wall portion connects the radial retention surface linearly with the main surface of the bottom wall, thereby modifying the shape of the upstream axial end of the platform so as to decrease the hub ratio. This rectilinear wall portion presents the advantage of being of a shape that is simple and easy to make, e.g. by machining.

In certain embodiments, the inclined surface is a curvilinear wall portion.

Consequently, the curvilinear wall portion connects the radial retention surface progressively with the main surface of the bottom wall, thereby modifying the shape of the upstream axial end of the platform so as to decrease the hub ratio. This curvilinear wall portion presents the advantage of smoothing the change of slope from the main surface of the bottom wall by avoiding the presence of any discontinuity at the junction between the inclined surface and the main surface, unlike the rectilinear wall portion, and thereby reducing stresses at this junction.

In certain embodiments, the inclined surface and the passage wall are substantially parallel.

Consequently, the upstream axial end of the platform presents a sloping shape, the inclined surface and the passage portion being inclined radially in the same manner in the direction in which the platform bears against the disk. This shape for the upstream axial end of the platform makes it possible to decrease the hub ratio.

The present disclosure also provides a disk suitable for supporting platforms and blades of a fan, and comprising:

- an outer surface presenting a succession of slots for receiving fan blades and of teeth interposed between the slots in order to support the fan platforms;
- an upstream face of the disk; and
- a plurality of axial projections arranged radially around the axis of the disk on the upstream face of the disk, and suitable for being fastened to a fan platform retention flange, the disk being characterized in that the projections are radially offset towards the inside of the disk relative to the teeth of the disk.

The term "upstream face" is used to mean upstream relative to the air flow direction when the disk is arranged in a fan.

The term "axial projections" is used to mean projections that are axial in the air flow direction when the disk is arranged in a fan.

The term "radially offset" is used to mean offset towards the inside of the disk, i.e. towards the axis of rotation of the disk.

The disk may have as many axial projections as it has teeth.

Each axial projection may include an orifice so that the axial projections can be fastened to a fan platform retention flange, e.g. by using a screw or a bolt.

Since the axial projections are offset radially towards the inside of the disk relative to the teeth of the disk, when the projections are fastened to a platform retention flange, the fastener zone located on the projections is thus offset radially relative to the teeth of the disk. This presents the advantage of limiting stresses on the teeth of the disk when an external element, e.g. a platform retention flange, is fastened to the disk.

Furthermore, since this fastening zone is radially offset relative to the teeth of the disk, this presents the advantage of releasing space at the upstream axial end of the teeth of the disk, e.g. making it possible to machine the teeth of the disk.

In certain embodiments, the axial projections are studs machined on the upstream face of the disk.

They may be in the shape of cubes, each having a fastener orifice machined axially in an upstream face of the projections. The fastener orifices can serve to fasten an external element to the disk, e.g. a retention flange or a shroud, e.g. by using a screw or a bolt. The axial projections may also include respective insertion orifices machined radially in outer faces of the projections. The insertion orifices may serve to allow fastener elements to be inserted for fastening the outer element to the disk.

In certain embodiments, an upstream axial end of the teeth of the disk presents a surface that is chamfered.

The chamfered surface may be in the form of an inclined surface that is inclined relative to the main surface of the tooth of the disk, towards the inside of the disk. The chamfered surface may be made by machining the upstream axial end of the tooth of the disk, for example. Such machining is made possible because of the space made available by the radial offset of the axial projections at the upstream face of the disk. The presence of this chamfered surface presents the advantage of making it possible to adapt the shape of a tooth of the disk to the shape of a platform that is to bear against the tooth, thereby reducing the hub ratio in order to improve the performance of the fan.

The present disclosure also provides an assembly comprising a disk and at least one platform, the assembly further comprising at least one upstream retention flange for axially and radially retaining the upstream end of the platform, wherein the upstream retention flange is fastened on a projection of the upstream face of the disk.

When the retention flange is fastened to the disk, the interface between the flange and the disk corresponding to the fastening zone of the flange on an axial projection of the disk is offset radially towards the inside of the disk relative to the tooth of the disk in comparison with known systems in which this surface is situated at the same level of the tooth of the disk. This offset serves to limit stresses at the upstream axial ends of the teeth and of the slots of the disk. Furthermore, the offset of this interface serves to release space at the upstream axial end of each tooth of the disk, providing greater potential for machining the teeth, and thus for modifying the shape of the platform and thereby decreasing the hub ratio.

In certain embodiments, when the platform bears against a tooth of the disk, the inclined surface of the bottom wall is in contact with the chamfered surface of the tooth of the disk, and the inclined surface and the chamfered surface are parallel.

Since the interface between the retention flange and the disk is offset towards the inside of the disk, the teeth of the disk can be machined more freely. Thus, the upstream axial end of the tooth may present a chamfer suitable for machining the shape of the platform, with the chamfered surface being parallel to the inclined surface of the platform. This presents the advantage of creating an assembly that is compact, in which the platform is held against the tooth of the disk by the retention flange fastened to a projection of the disk.

In certain embodiments, the upstream retention flange is a shroud.

The present disclosure also provides a turbine engine fan comprising an assembly according to any of the embodiments described in the present disclosure together with a plurality of blades mounted in the slots of the disk.

BRIEF DESCRIPTION OF THE DRAWINGS

The invention and its advantages can be better understood on reading the following detailed description of various embodiments of the invention given as non-limiting examples. The description refers to the accompanying sheets of figures, in which.

DETAILED DESCRIPTION OF EMBODIMENTS

In the present disclosure, the term "longitudinal" and its derivatives are defined relative to the main direction of the platform under consideration; the terms "radial", "inner", "outer", and their derivatives are defined relative to the main axis of the turbine engine; and finally the terms "upstream" and "downstream" are defined relative to the flow direction of the fluid passing through the turbine engine. Furthermore, and unless specified to the contrary, in the various figures the same reference signs designate the same characteristics.

Figure 1:
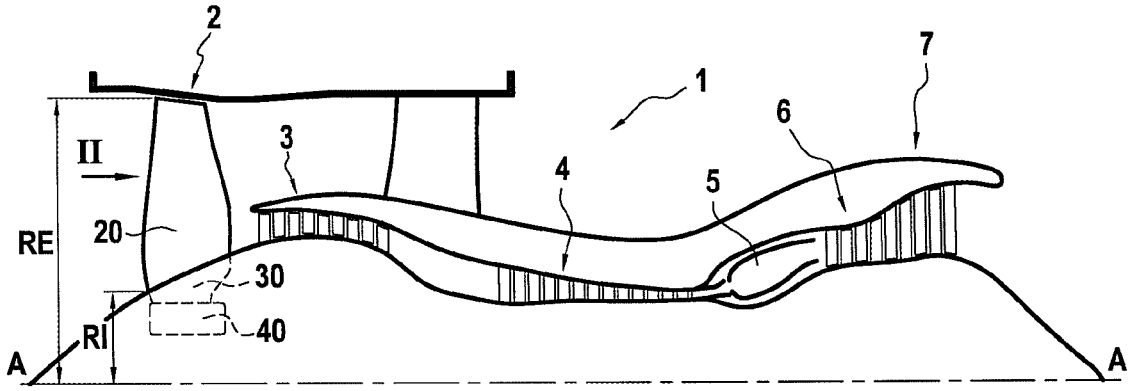
FIG. 1 is a diagrammatic section view of a turbine engine of the invention.

FIG. 1 is a diagrammatic longitudinal section view of a double-flow turbojet 1 of the invention centered on an axis A. From upstream to downstream it comprises: a fan 2, a low-pressure compressor 3, a high-pressure compressor 4, a combustion chamber 5, a high-pressure turbine 6, and a low-pressure turbine 7.

Figure 2:
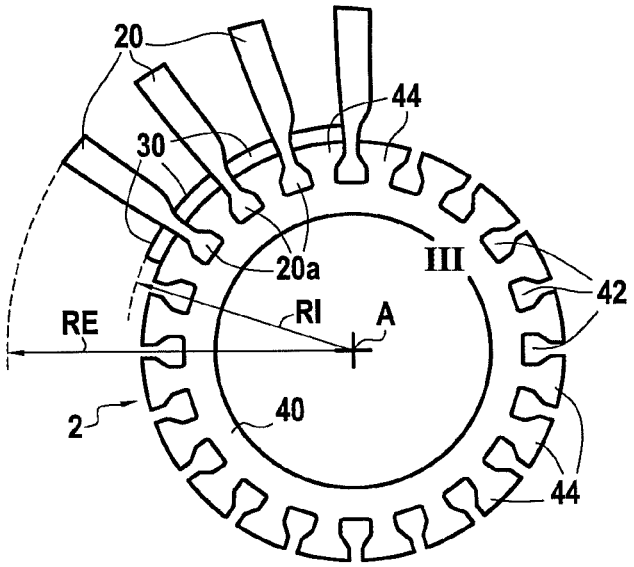
FIG. 2 is a diagrammatic view of the FIG. 1 fan, seen looking along direction II.

FIG. 2 is a diagrammatic view of the FIG. 1 fan 2 seen looking in direction II. The fan 2 has a fan disk 40 with a plurality of slots 42 formed in its outer periphery. These slots 42 are rectilinear and they extend axially from upstream to downstream all along the disk 40. They are also regularly distributed around the axis A of the disk 40. In this way, each slot 42 co-operates with a neighboring slot to define a tooth 44 that likewise extends from upstream to downstream all along the disk 40. In equivalent manner, a slot 42 is defined between two neighboring teeth 44.

The fan 2 also has a plurality of blades 20 of curvilinear profile (only four blades 20 are shown in FIG. 2). Each blade 20 possesses a root 20*a* that is mounted in a corresponding slot 42 of the fan disk 40. For this purpose, the root 20*a* of a blade 20 may be of Christmas-tree shape or of dovetail shape to match the shape of the slots 42.

Finally, the fan 2 has a plurality of platforms 30 fitted thereon, each platform 30 being mounted in the gap between two neighboring fan blades 20, in the vicinity of their roots 20*a*, so as to define the inside of an annular air inlet passage into the fan 2, the passage being defined on the outside by a fan casing.

FIGS. 1 and 2 also show an inner radius RI and an outer radius RE. The inner radius RI corresponds to the radius measured between the axis of rotation A and the point of the leading edge of a blade 20 that is flush with the surface of a platform 30. The outer radius RE corresponds to the radius measured between the axis of rotation A and the outermost point of the leading edge of a blade 20. These two radii RI and RE are the radii used for calculating the hub ratio RI/RE, that is to be reduced by means of the assembly of the invention (in particular by reducing the inner radius RI). In other words, reducing the hub ratio, in particular by acting on the inner radius RI, amounts to shifting the aerodynamic air inlet passage as close as possible to the fan disk.

Figure 3A:
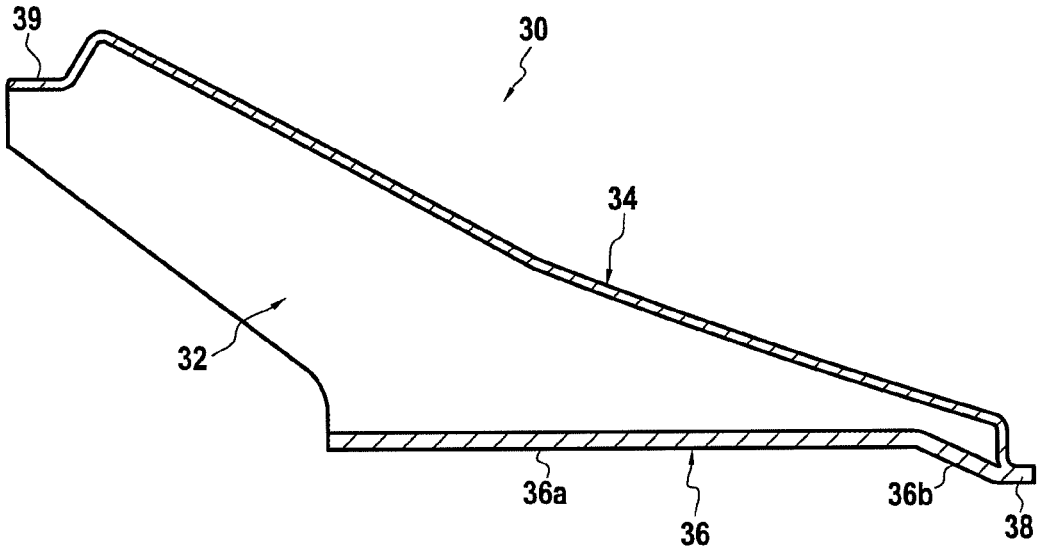
FIGS. 3A and 3B are longitudinal section views of a platform of the invention.
Figure 3B:
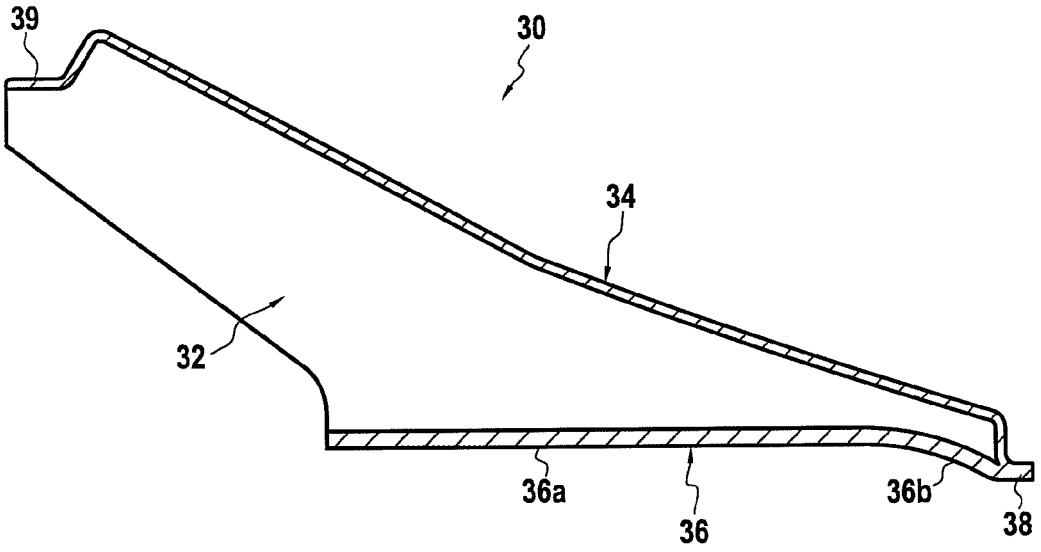

FIGS. 3A and 3B are longitudinal section views of the platform 30. The platform 30 of the present invention comprises a passage wall 34, a bottom wall 36, and radial and axial retention surfaces 38 and 39 arranged at the two axial ends of the platform 30. The assembly formed by the passage wall 34 and the wall 36 forms a box 32 constituting the platform 30. The bottom wall is constituted by a main surface 36*a* and an inclined surface 36*b*. The inclined surface 36*b* connects the main surface 36*a* continuously with the retention surface 38, such that the retention surface 38, which is situated at the upstream axial end of the platform, is radially offset relative to the main surface 36*a*. In the example of FIG. 3A, the inclined surface 36*b* is a rectilinear wall portion. In the example of FIG. 3B, the inclined surface 36*b* is a curvilinear wall portion.

Figure 4:
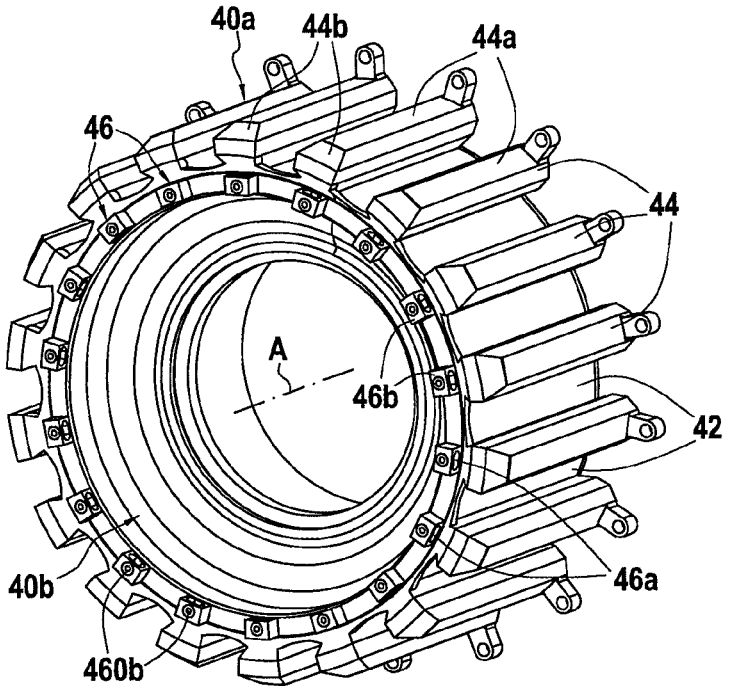
FIG. 4 is a perspective view of a disk of the invention.
Figure 5:
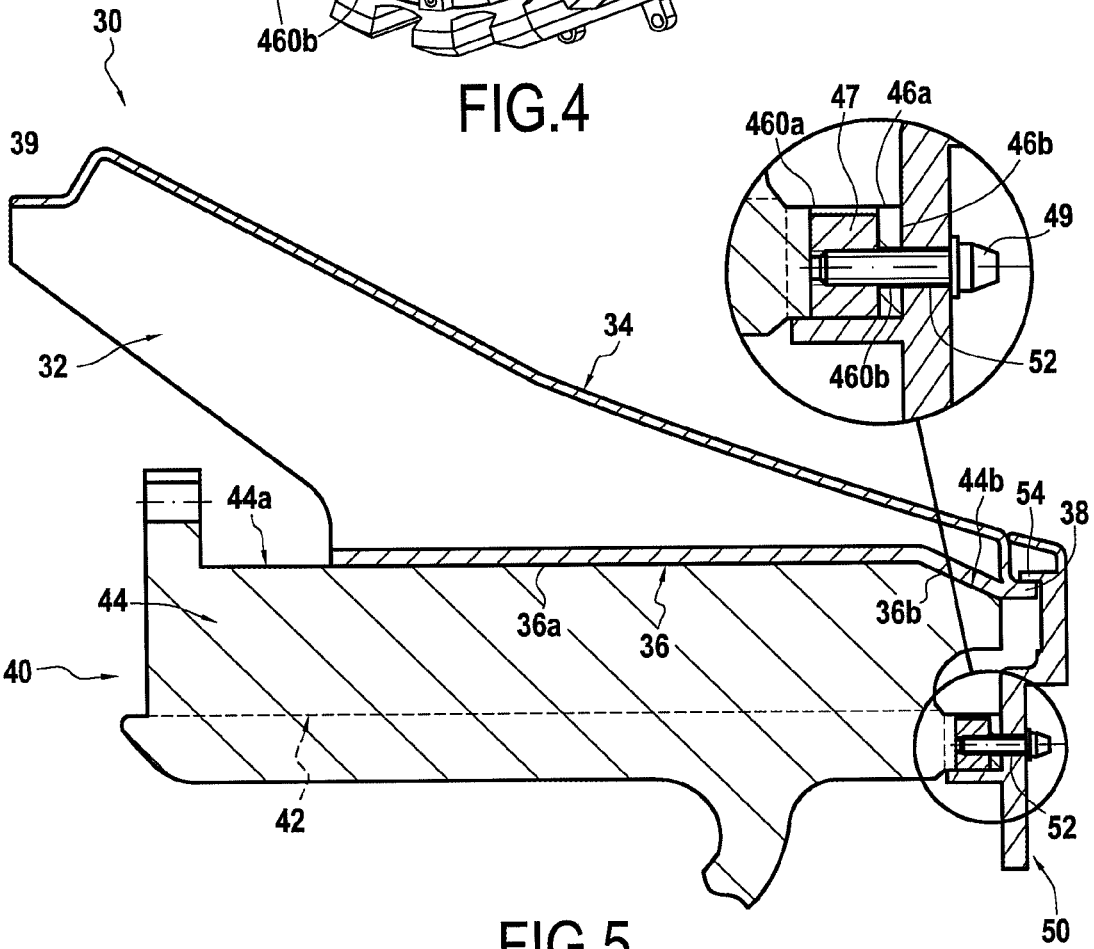
FIG. 5 is a longitudinal section view of an assembly comprising a retention flange, a platform, and a disk of the invention.

FIG. 4 is a perspective view of a fan disk having an outer surface 40*a* and an upstream face 40*b*. The outer surface 40*a* presents a succession of slots 42 each suitable for receiving a root 20*a* of a fan blade 20, with teeth 44 interposed between the slots 42, and suitable for supporting the fan platforms 30. Each tooth 44 has a main tooth surface 44*a* and chamfered surface 44*b*. The chamfered surface 44*b* is made, e.g. by machining the upstream axial end of the tooth 44, so that the shape of the chamfered surface 44*b* is identical to the shape of the inclined surface 36*b* of the platform 30. Consequently, when a platform 30 bears against a tooth 44, the main surface 36*a* of the platform is in contact with the main surface of the tooth 44*a*, and the inclined surface 36*b* of the platform is in contact with the chamfered surface 44*b* of the tooth, as shown in FIG. 5.

Furthermore, on its upstream face 40*b*, the disk 40 has a plurality of axial projections 46, that may be in the shape of cubes and disposed circumferentially at regular intervals around the axis A. The number of axial projections 46 may be equal to the number of teeth 44, each projection 46 being in radial alignment with the corresponding tooth 44. Furthermore, each axial projection 46 is radially offset towards the inside of the disk, i.e. towards the axis A, relative to the corresponding tooth 44. For example, the distance between the axis A and an outer face 46*a* of a projection 46 may be shorter than the distance between the axis A and a slot 42.

Each axial projection 46 may have a fastener orifice 460*b* in its upstream face 46*b* suitable for receiving fastener means 49, e.g. a screw or a bolt. Each axial projection 46 may also include an insertion orifice 460*a* in its outer face 46*a*, suitable for receiving a fastener element 47, e.g. an insert that includes a tapped hole. An upstream retention flange 50, e.g. a shroud, can thus be fastened to an axial projection 46, e.g. by inserting the fastener means 49 through an orifice in the flange 52 and the fastener orifice 460*b* in the projection, the fastener element 49 then being fastened, e.g. screw fastened, to the fastener element 47 that is inserted via the insertion orifice 460*a* of the projection. With the retention flange 50 fastened to the disk 40, the top surface 54 of the flange 50 then serves to provide the platform 30 with radial retention.

Since the fastening zone between the disk 40 and the retention flange 50 is situated at the axial projections 46, that makes it possible, while the fan is in operation, to limit the stresses exerted on sensitive surfaces such as the upstream axial ends of the tooth 44 and the slots 42 of the disk. Furthermore, since, compared with known structures, this interface between the disk 40 and the retention flange 50 is radially offset relative to the teeth of the disk, that makes it possible to reduce space at the upstream axial ends of the teeth of the disk. It is consequently possible to modify more freely the upstream axial ends of the teeth 44, and thus the upstream axial end of the platform 30, and thereby reduce the hub ratio so as to optimize the performance of the fan, and thus of the turbine engine in which the fan is mounted. By way of example, FIG. 5 shows a platform 30 in which the box 32 possesses a shape that slopes towards the inside of the disk 40 as a result of the chamfered surface 44*b* of the disk 40 and of the inclined surface 36*b* of the platform 30.

Although the present invention is described with reference to specific embodiments, it is clear that modifications and changes may be undertaken thereon without going beyond the general ambit of the invention as defined by the claims. In particular, individual characteristics of the various embodiments shown and/or mentioned can be combined in additional embodiments. Consequently, the description and the drawings should be considered in a sense that is illustrative rather than restrictive.

The invention claimed is:

1. A platform suitable for being interposed between two adjacent blades of a fan, the platform comprising:

a passage wall for defining a fan air flow passage;

a bottom wall having a main surface for bearing against a fan disk;

the platform having axial and radial retention surfaces arranged at the two axial ends of the platform, the radial retention surface arranged at the upstream axial end of the platform being radially offset from the main surface of the bottom wall in the direction in which the bottom wall bears against the disk, wherein the bottom wall has an inclined surface inclined relative to the main surface of the bottom wall and connecting the main surface of the bottom wall in continuous manner with the radial retention surface arranged at the upstream axial end of the platform, wherein the radial retention surface and the main surface of the bottom wall are parallel to each other.

2. The platform according to claim 1, wherein the inclined surface is a rectilinear wall portion.

3. The platform according to claim 1, wherein the inclined surface is a curvilinear wall portion.

4. The platform according to claim 1, wherein the inclined surface and the passage wall are parallel.

5. The platform according to claim 1, wherein the axial and radial retention surfaces arranged at the two axial ends of the platform are configured to retain the platform and hold the platform in position relative to the disk on which the platform bears while the disk is moving.

6. An assembly comprising at least one platform suitable for being interposed between two adjacent blades of a fan and a disk, the platform comprising:

a passage wall for defining a fan air flow passage;

a bottom wall having a main surface for bearing against a fan disk;

the platform having axial and radial retention surfaces arranged at the two axial ends of the platform, the radial retention surface arranged at the upstream axial end of the platform being radially offset from the main surface of the bottom wall in the direction in which the bottom wall bears against the disk, wherein the bottom wall has an inclined surface inclined relative to the main surface of the bottom wall and connecting the main surface of the bottom wall in continuous manner with the radial retention surface arranged at the upstream axial end of the platform, the disk comprising:

an outer surface presenting a succession of slots for receiving fan blades and of teeth interposed between the slots in order to support the fan platforms;

an upstream face of the disk; and a plurality of axial projections arranged radially around the axis A of the disk on the upstream face of the disk, and suitable for being fastened to a fan platform retention flange, the projections being radially offset towards the inside of the disk relative to the teeth of the disk, wherein upstream axial ends of the teeth of the disk present surfaces that are chamfered, the assembly further comprising at least one upstream retention flange for axially and radially retaining the upstream end of the platform, wherein the upstream retention flange is fastened on an axial projection of the upstream face of the disk.

7. The assembly according to claim 6, wherein, when the platform bears against a tooth of the disk, an inclined surface of the bottom wall is in contact with the chamfered surface of the tooth of the disk, and the inclined surface and the chamfered surface are parallel.

8. The assembly according to claim 6, wherein the upstream retention flange is a shroud.

9. A turbine engine fan comprising an assembly according to claim 6 together with a plurality of blades mounted in slots of the disk.

10. The assembly according to claim 6, wherein the axial projections are studs machined on the upstream face of the disk.

11. The assembly according to claim 6, wherein the fastening zone between the retention flange and the disk is offset radially towards the inside of the disk.

12. The assembly according to claim 6, wherein the axial projections are in the shape of cubes and disposed circumferentially at regular intervals around the axis A.

13. The assembly according to claim 6, wherein each axial projection has a fastener orifice in its upstream face suitable for receiving a screw or a bolt, and each axial projection includes an insertion orifice in its outer face, in which an insert that includes a tapped hole is inserted.

* * * * *